US008991669B2

(12) United States Patent
Priest et al.

(10) Patent No.: US 8,991,669 B2
(45) Date of Patent: Mar. 31, 2015

(54) TREE STICK AND CARRIER SYSTEM

(71) Applicant: DDI, Inc., Dubuque, IA (US)

(72) Inventors: John Brian Priest, Dubuque, IA (US); Frank Milton Lovich, II, Dubuque, IA (US)

(73) Assignee: DDI, Inc., Dubuque, IA (US)

( * ) Notice: Subject to any disclaimer, the term of this patent is extended or adjusted under 35 U.S.C. 154(b) by 2 days.

(21) Appl. No.: 14/092,907

(22) Filed: Nov. 27, 2013

(65) Prior Publication Data

US 2014/0158735 A1 Jun. 12, 2014

Related U.S. Application Data

(60) Provisional application No. 61/731,425, filed on Nov. 29, 2012.

(51) Int. Cl.

| | |
|---|---|
| ***E06C 7/00*** | (2006.01) |
| ***A45F 3/14*** | (2006.01) |
| ***B65B 11/00*** | (2006.01) |
| ***A45F 3/00*** | (2006.01) |
| ***A45F 3/02*** | (2006.01) |
| *E06C 1/38* | (2006.01) |

(52) U.S. Cl.

CPC . *B65B 11/00* (2013.01); *E06C 7/00* (2013.01); *E06C 1/381* (2013.01); *A45F 2003/142* (2013.01); *A45F 3/00* (2013.01); *A45F 3/02* (2013.01); *A45F 3/14* (2013.01)

USPC ..... 224/257

(58) Field of Classification Search

CPC ..... E06C 1/381

USPC ..... 224/249, 250, 257, 258, 259, 917; 150/154–168; 182/100, 116

See application file for complete search history.

(56) References Cited

U.S. PATENT DOCUMENTS

| | | | | |
|---|---|---|---|---|
| 4,934,833 | A * | 6/1990 | Linder | 383/4 |
| 5,040,635 | A * | 8/1991 | Strickland | 182/100 |
| 5,092,506 | A * | 3/1992 | Bolduc | 224/658 |
| 5,454,445 | A * | 10/1995 | Berryman | 182/116 |
| 6,141,891 | A * | 11/2000 | Troccola | 37/196 |
| 6,491,196 | B1 * | 12/2002 | Coler | 224/602 |
| 6,889,882 | B1 * | 5/2005 | Leep | 224/579 |
| 8,584,861 | B2 * | 11/2013 | Porath | 206/756 |
| 2005/0230186 | A1 * | 10/2005 | Bigard | 182/100 |
| 2007/0204943 | A1 * | 9/2007 | Beakey | 150/154 |
| 2007/0261771 | A1 * | 11/2007 | Fitzgerald | 150/154 |
| 2008/0196972 | A1 * | 8/2008 | Bell | 182/92 |

* cited by examiner

*Primary Examiner* — Justin Larson

(74) *Attorney, Agent, or Firm* — Rathe Lindenbaum LLP

(57) ABSTRACT

A tree stick carrier for a tree stick having steps projecting from a post comprises a flexible panel having openings spaced to correspond to the steps and a retainer coupled to the panel to retain the panel in a state wrapped about the post with the steps projecting through the openings.

19 Claims, 2 Drawing Sheets

TREE STICK AND CARRIER SYSTEM

CROSS-REFERENCE TO RELATED PATENT APPLICATIONS

The present application is a non-provisional application claiming priority from co-pending U.S. Provisional Application Ser. No. 61/731,425 filed on Nov. 29, 2012 by John Brian Priest et al. and entitled TREE STICK AND CARRIER SYSTEM, the full disclosure of which is hereby incorporated by reference.

BACKGROUND

Tree sticks are utilized by hunters and by wildlife observers to climb or scale trees. Some tree sticks enable the hunter or observer to climb to an elevated platform or tree stand. Existing tree sticks are cumbersome to store and transport. Existing tree sticks may not ergonomically fit the hunters or wildlife observers.

DETAILED DESCRIPTION OF THE EXAMPLE EMBODIMENTS

Figure 1:
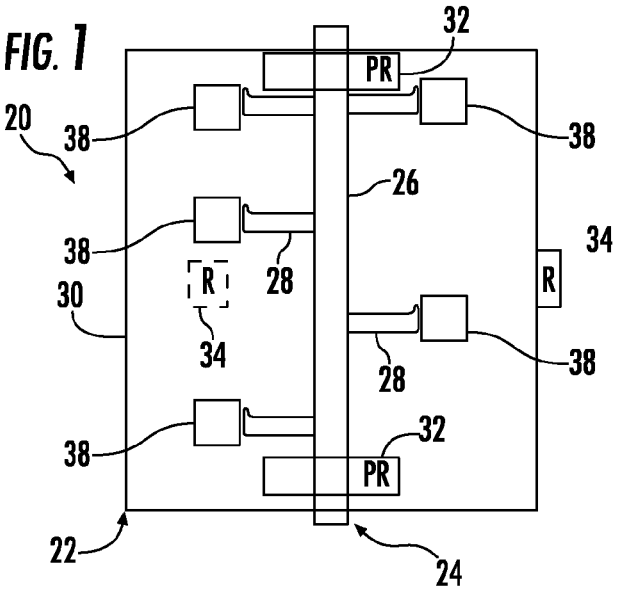
FIG. 1 is a side view of an example tree stick and carrier system in an open state.
Figure 2:
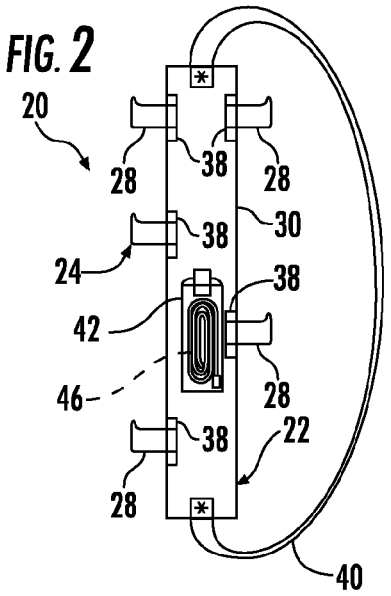
FIG. 2 is a side view of the tree stick and carrier system of FIG. 2 in a closed state.
Figure 3:
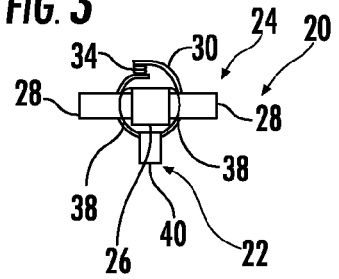
FIG. 3 is a top view of the tree stick and carrier system of FIG. 2.

FIGS. 1-3 illustrate an example tree stick and carrier system 20. System 20 facilitates transport and storage of a tree stick. System 20 comprises carrier 22 and tree stick 24. Tree stick 24 generally comprises post 26 and steps 28 projecting from post 26. In one implementation, steps 28 extend in opposite transverse directions away from post 26. In some implementations, steps 28 on opposite sides of post 26 are in substantial alignment, whereas in other implementations, steps 28 are staggered.

Carrier 22 wraps about and protects post 26 and the junctures between post 26 and steps 28. Carrier 22 facilitates easy handling, manipulation and transport of tree stick 24. Carrier 22 comprises panel 30, post retainers 32 and panel retainers 34.

Panel 30 comprises a sheet or panel of flexible material having a sufficient flexibility so as to allow panel 30 so as to wrap about post 26. In one implementation, panel 30 comprises one or more sheets of a fabric material, such as a canvas material. In other implementations, panel 30 may be formed from polymeric sheets or other sheets or panels of flexible and foldable material. As shown by FIG. 1, panel 30 comprises openings 38 which extend through panel 30 at spaced locations corresponding to steps 28. Although openings 38 are illustrated as being rectangular, in other implementations, openings 38 may have other sizes and shapes allowing steps 28 pass-through openings 38. One implementation, openings 38 may be lined with an elastic material, allowing openings 38 to resiliently flex to a larger state as steps 28 are pass-through opening 38, wherein openings 38 constrict about a received step 28 to seal against the received step 28. In some implementations, openings 38 may alternatively comprise slits, with or without elastic perimeters. Although panel 30 is illustrated as including an individual opening 38 for each step 28, in other implementations, panel 30 may be provided with an opening which receives greater than a single step 28. In one implementation, openings 38 may comprise a pair of continuous elongate slits through which the steps 28 on each side of post 26 project. Openings 38 enable panel 32 more closely wrap about post 26 thus to reduce the overall profile or footprint of panel 30 of securely retaining and protecting tree stick 24. In some implementations, openings 38 further permit 728 project from panel 30, allowing additional items to be hung from steps 28 for transport.

Post retainers 32 (schematically shown) comprise mechanisms configured to retain post 26 within and against panel 30. In one implementation, post retainers 32 comprise loops through which and portions of post 26 are inserted. In one implementation post retainers 32 comprise straps releasably retained in closed states about post 32 using hook and loop fastener systems (also known as VELCRO). In yet other implementations, post retainers 32 may comprise straps releasably retained in closed states using buttons, snaps, buttons and the like. In some implementations, post retainers 32 may be omitted. For example, the provision of openings 38 themselves may assist in retaining post 26 in place against and within panel 30.

Panel retainers 34 (schematically shown) comprise mechanisms coupled to panel 30 which are configured to retain panel 30 in a state wrapped about post 26 with steps 28 projecting through openings 38 as shown in FIGS. 2 and 3. In one implementation, panel retainers 34 may comprise a single panel retainer comprising two separate portions of a hook and loop fastener arrangement coupled to different portions of panel 30 such that when fully wrapped about post 26, such hooks and loops engage one another to releasably retain panel 30 in the wrapped state. In other implementations, panel retainers 34 may comprise other mechanisms for releasably securing different portions of panel 30 together while panel 30 is in a wrapped state. Examples of such mechanisms include, but are not limited to, zippers, snaps, hooks, buttons, tieable straps, cables or ropes and the like.

FIGS. 2 and 3 illustrate system 20 in a closed state. As shown by such figures, steps 28 project through openings 38 when panel 30 is retained in a raptor folded state about post 26. As shown by FIGS. 2 and 3, and one implementation, system 20 may additionally comprise shoulder strap 40 and pocket 42. Shoulder strap 40 is secured to opposite ends of panel 30 and facilitates carrying system 20. In other implementations, additional or alternative straps may be used for facilitating manual, hand carrying of system 20. In some implementations, a pair of straps 30 may be provided to facilitate carrying of system 20 as a backpack. In some implementations, strap 40 may be omitted.

Pocket 42 comprise a pocket formed on an exterior (or an interior in some implementations) of panel 30. Pocket 42 is configured to receive accessories of tree stick 24 such as strap 46 utilized to secure post 26 against a tree. An example illustrated, pocket 42 is releasably closable by a hook and loop fastener arrangement, a zipper, a latch, a button hook or the like. In other implementations, system 20 may include additional pockets or pocket 42 may be omitted.

Figure 4:
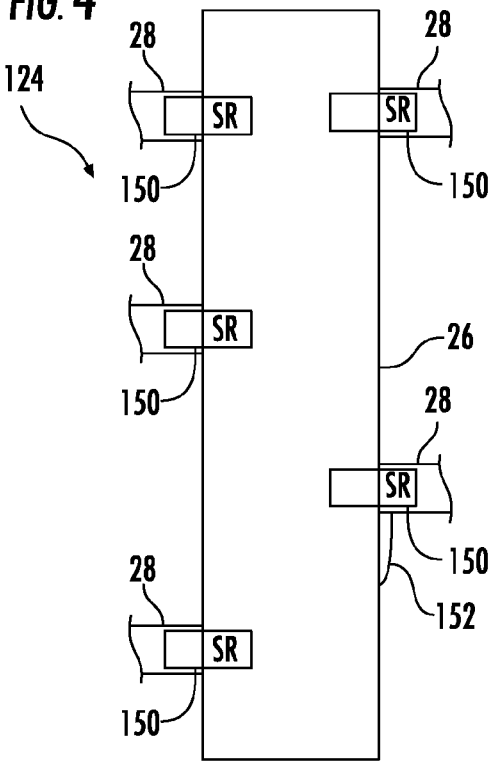
FIG. 4 is enlarged fragmentary view of another example of the tree stick of FIG. 1.

FIG. 4 is an enlarged fragmentary view illustrating tree stick 124, a particular example implementation of tree stick 24. Tree stick 124 is similar to tree stick 24 and that tree stick 124 comprises post 26 and steps 28. However, tree stick 124 is specifically configured such that one or more of steps 28 are removably mountable to or coupled to post 26. In particular, post 124 comprises step retention mechanisms 150 (schematically shown). Step retention mechanisms 150 enable steps 28 to be separated and removed from post 26 and later remounted or reattached to post 26. As a result, post 26 and steps 28 are more easily packed to facilitate compact storage and transport. In addition, tree stick 124 may left in place on a tree overnight or until further use with one or more of the lower or intermediate steps 28 removed from post 26. As a result, the risk of a child or a stranger using tree stick 124 or gaining access to an overhead tree stand (or property stored in the tree stand) is reduced.

In one implementation, each of step retention mechanisms 150 comprises a hook associated with one of post 26 and one of steps 28 and a hook receiver (or detent) associated with the other of post 26 and said one of the steps 28, wherein the hook receiver receives the hook to releasably secure the step 28 in a substantially horizontal orientation, projecting substantially perpendicular to the vertical axis of the associated post 26 and tree. In yet other implementations, other step retention mechanisms may be employed to secure and retain step 28 to post 26 while also allowing the particular step 28 to be dislodged, disconnected and completely separated from post 26. For example, in some implementations, hook retention mechanisms 150 may comprise fasteners, such as screws or bolts, which releasably secure steps 28 to post 26. In yet other implementations, hook retention mechanisms 150 may comprise snaps, clips and the like. In some implementations, post 124 may include tethers 152 (one of which is shown) between a step 28 and post 26, providing accidental loss of a particular step 28. Such tethers 152 may be disconnectable from one or both of post 26 and the associated step 28 to allow the particular step 28 to be stored away from post 26, such as when post 26 is left on a tree and the particular step 28 is removed to prevent use of tree stick 124.

Figure 5:
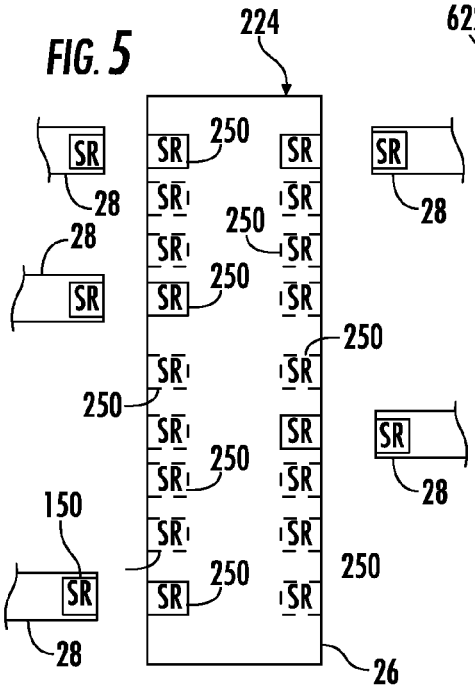
FIG. 5 is a schematic diagram of another example of the tree stick of FIG. 1.

FIG. 5 illustrates tree stick 224, another implementation of tree stick 24. Tree stick 224 is similar to tree stick 124 in that tree stick 224 comprises post 26 and individual steps 28 which are removably connectable to or coupled to post 26. However, unlike posts 26 of tree stick 124, post 26 of tree stick 224 includes a multitude of step retention mechanisms 250 at spaced locations along post 26. As shown by FIG. 5, the number of step retention mechanisms 250 associated with post 26 outnumbers the number of steps 28 having their associated step retention mechanisms 150. The numerous step retention mechanisms 250 associate with post 26 facilitate selective positioning of steps 28 along post 26. As a result, a hunter or wildlife observer may selectively secure steps 28 at any of a variety of different positions along post 26 to accommodate the individual's personal preferences or to accommodate the individual's ergonomic characteristics. For example, a tall individual having long legs may prefer a greater distance between steps 28 as compared to an individual shorter in stature. The numerous step retention mechanisms 250 further permit individual to align or stagger the arrangement or layout of steps 28 as desired. An individual may you lies as many or as few as steps 28 as he or she wishes.

Figure 6:
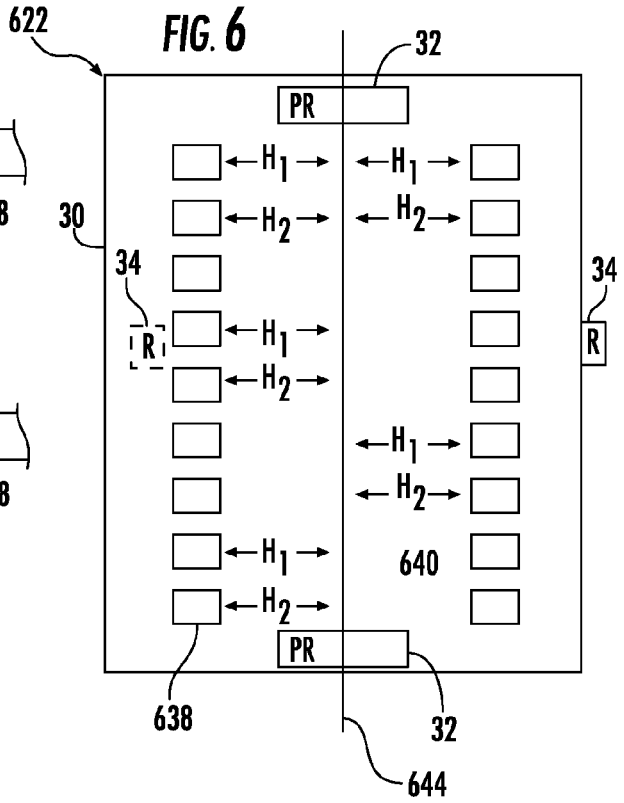
FIG. 6 is a side view of an example carrier system for use with the example tree stick of FIG. 5.

FIG. 6 illustrates tree stick carrier 622, an example implementation of tree stick carrier 22. An example illustrated, tree stick carrier 622 is configured for use with a tree stick such as tree stick 224, wherein steps 28 may be releasably mounted to a post 26 at one of multiple spaced locations, wherein the number of spaced locations outnumbers the number of steps 28. Carrier 622 is identical to carrier 22 except that carrier 622 comprises openings 638 and indicia 640. Those remaining components of carrier 622 which correspond to components of carrier 22 are numbered similarly. Although not illustrated, carrier 62 may additionally comprise strap 40 and pocket 42 as shown and described above was with respect to FIGS. 2 and 3.

As shown by FIG. 6, post retainers 32 pertain post 26 (shown in FIG. 1) along an axis 644. As shown by FIG. 6, opening 638 extend through panel 30 on opposite sides of axis 644. Openings 638 are similar to openings 38 except that opening 0638 extend that multiple locations along opposite sides of axis 644, wherein the multiple locations outnumber the number of steps 28 which may extend from the post to be mounted by post retainers 32. Example straight, openings 638 correspond in location to the location of each of strap retainers 250 and post 26 of tree stick 224. As a result, carrier 622 may accommodate any of the selected locations at which steps 28 are mounted to post 26 such that an individual does not need to disconnect or reposition steps 28 to fit tree stick 224 within carrier 622. As noted above, opening 0638 may have various sizes, shapes and configurations.

Indicia 640 comprise text, graphics, markings, protrusions, serrations or grooves configured to identify different sets of openings 638, wherein each set of openings has different spacings recommended for individuals of different heights or statures. In the example illustrated, carrier 622 comprises indicia 640 in the form of textual markings sewn into, adhered upon, stamped upon, burned into or printed upon an inside surface of panel 30 at locations corresponding to the different positions for steps 28 at the different step spacings. In the example illustrated, indicia 640 identify two possible sets of step positions for persons having heights H1 and H2. Such indicia indicate at which openings 638 individual steps 28 should be aligned with when being removably mounted to post 26. For example, an individual may place post 26 along axis 644 and utilize indicia 642 properly position steps 28 at appropriate locations along post 26 to accommodate his or her individual height. As a result, steps 28 may be mounted to post 26 at spacings that best accommodate ergonomic characteristics of the person using tree stick 224. In some implementations, indicia 640 may alternatively comprise distinct markings which simply identify different positions for steps 28. For example, each of openings 638 may be right with a distinct number, wherein once a person identifies his or her desired step spacing, the individual may record the individual opening numbers or identifications for subsequently reattaching steps 28 to post 26 to duplicate and repeat the desired step spacing. In some implementations, indicia 640 may be omitted.

Figure 7:
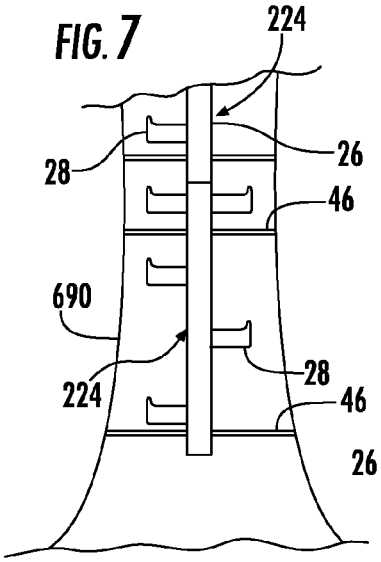
FIG. 7 is a fragmentary view illustrating the tree stick of FIG. 4 or FIG. 5 mounted along a tree.

FIG. 7 the fragmentary view illustrating tree stick 224 (or alternatively tree stick 124) mounted along a tree 690 utilizing straps 46. As shown by FIG. 7, multiple tree sticks 224 may be consecutively mounted along tree 690 or may be consecutively mounted to one another in an end-to-end relationship along tree 690 to reach greater heights along tree 690. In some implementations, panel 30 and openings 38 (or openings 638) may be sized so as to accommodate multiple tree sticks 224 stacked upon one another, wherein panel 30 concurrently wraps about the multiple posts 26 and is retained in a wrapped state by retainers 34 with multiple steps 28 extending through each opening 38 (or opening 638). In some implementations, panel 30 may include distinct openings for each of the steps 28 which are stacked upon one another in substantial alignment with one another.

Figure 8:
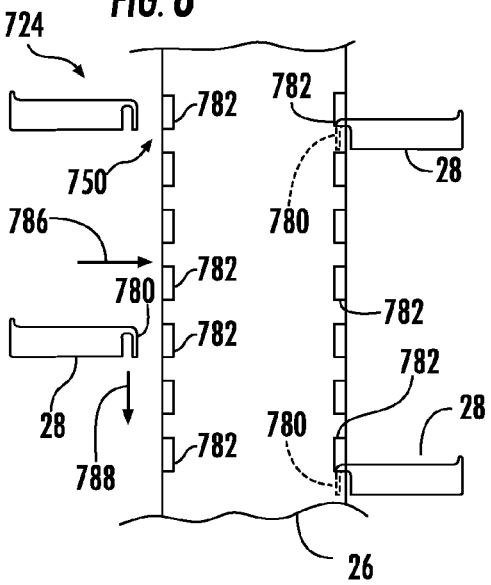
FIG. 8 is an enlarged fragmentary side view of another example of the tree stick of FIG. 5.

FIG. 8 is an enlarged fragmentary view illustrating tree stick 724, a particular example of tree stick 224. Tree stick 724 is similar to tree stick 224 except that tree stick 724 is specifically illustrated as comprising the step retention mechanisms 750. Step retention mechanisms 750 include scratch that comprise a look 780 associate with each step 28 and a series of hook receivers 782 extending along post 26. In one implementation, post 26 comprises a tubular member (square, rectangular or round), wherein hook receivers 782 comprise spaced sidewall openings and opposite sidewalls of the tubular member. When a step 28 is to be mounted to post 26 at a selected location along post 26, book 780 is first inserted in the direction indicated by arrow 786 through and into the hook receivers 782. Thereafter, hook 780 is moved in a vertically downward direction is indicated by arrow 788 until book 780 catches upon the sidewalls of the tubular member 26 (shown the right side of FIG. 8).

Figure 9:
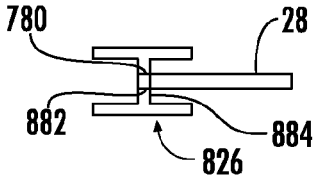
FIG. 9 is a sectional view of another example implementation of the tree stick of FIG. 1.
Figure 10:
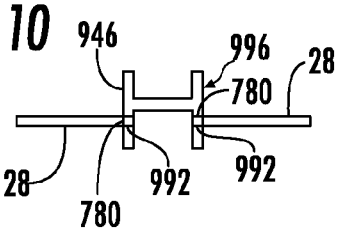
FIG. 10 is a sectional view of another example implementation of the tree stick of FIG. 1.

In other implementations, step retention mechanisms 750 may include other securement structures or mechanisms for further securing step 28 in place once the associated book 780 is engaging post 26. Although post 26 is illustrated as a tubular member, in other implementations, post 26 may have other shapes. For example, in other implementations, post 26 may comprise an I-beam, wherein one or more panels or walls of the I-beam include spaced I-beam openings through the I-beam for the reception of hooks 780 associated with steps 28. FIGS. 9 and 10 are sectional views illustrating alternative implementations of posts formed from I-beams. FIG. 9 is a sectional view of a post 826 in the form of an I-beam, wherein openings 882 extend at spaced locations along and through the connecting wall 884 of the I-beam. As a result, hooks 780 of steps 28 hook within such openings 882 so as to extend substantially perpendicular to post 826. FIG. 10 is a sectional view of post 926 in the form of an I-beam, wherein openings 992 extend at spaced locations along and through the opposite sidewalls 996. As a result, hooks 780 of steps 28 hook within such openings 992 so as to extend substantially perpendicular to post 996.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Although the present disclosure has been described with reference to example embodiments, workers skilled in the art will recognize that changes may be made in form and detail without departing from the spirit and scope of the defined subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a tree stick carrier for a tree stick having steps projecting from a post, the carrier comprising:

a flexible panel having openings specifically placed and spaced to correspond to the steps; and a retainer coupled to the panel to retain the panel in a state wrapped about the post with the steps projecting through the openings.

2. The apparatus of claim 1 further comprising a shoulder strap coupled to the panel.

3. The apparatus of claim 1 further comprising a pocket coupled to the panel.

4. The apparatus of claim 1, wherein the retainers comprise:

spaced straps;

hook and loop fastener mechanisms associated with the straps and the panel to retain the straps while the straps are wrapped about the post.

5. The apparatus of claim 1, wherein the retainers are configured to retain the post along an axis and wherein the openings arranged on opposite sides of the axis.

6. The apparatus of claim 5, wherein the openings are symmetrically arranged on opposite sides of the axis.

7. The apparatus of claim 5, where the openings are asymmetrically arranged on opposite sides of the axis.

8. The apparatus of claim 5, wherein the openings are symmetrically and asymmetrically arranged on opposite sides of the axis.

9. The apparatus of claim 1, wherein the panel includes a number of the openings greater than a number of the steps of the tree stick and wherein the panel comprises indicia identifying different sets of the openings, each of the sets of the openings having different spacings recommended for individuals of different heights.

10. The apparatus of claim 1, wherein the panel includes a number of the openings greater than a number of the steps of the tree stick to accommodate different step spacings.

11. The apparatus of claim 10, wherein the panel comprises indicia identifying different step spacings recommended for individuals of different heights.

12. The apparatus of claim 1 further comprising the tree stick.

13. The apparatus of claim 12, wherein the tree stick comprises:

the post;

the steps projecting from the post, wherein the steps are removably coupled to the post at spaced locations.

14. The apparatus of claim 13 further comprising step retention mechanisms along the post.

15. The apparatus of claim 14, wherein the step retention mechanisms each comprise:

a hook associated with one of the post and one of the steps; and a hook receiver associated with the other of the post and said one of the steps, the hook receiver receiving the hook.

16. The apparatus of claim 15, wherein post comprises a plurality of the hook receivers space along the post, wherein the plurality of hook receivers are greater in number than a number of the steps.

17. The apparatus of claim 16, wherein the post comprises a tubular member and wherein the plurality of hook receivers comprise spaced sidewall openings in opposite sidewalls of the tubular member.

18. The apparatus of claim 16, wherein the post comprises an I-beam, wherein the plurality of hook receivers comprise spaced I-beam openings through the I-beam.

19. A method comprising:

wrapping a flexible panel about a tree stick with openings of the flexible panel aligned with steps of the tree stick such that the steps project through the openings; and retaining the flexible panel in a wrapped state about the tree stick.

* * * * *